US008355648B2

(12) United States Patent
Hirukawa et al.

(10) Patent No.: US 8,355,648 B2
(45) Date of Patent: Jan. 15, 2013

(54) CARTRIDGE

(75) Inventors: Kuniaki Hirukawa, Susono (JP); Toshiyuki Shuto, Oita (JP); Tsutomu Nishiuwatoko, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 12/859,977

(22) Filed: Aug. 20, 2010

(65) Prior Publication Data

US 2011/0058846 A1 Mar. 10, 2011

(30) Foreign Application Priority Data

Sep. 8, 2009 (JP) ..... 2009-206534
Jun. 29, 2010 (JP) ..... 2010-147461

(51) Int. Cl.
*G03G 15/08* (2006.01)

(52) U.S. Cl. ..... 399/106

(58) Field of Classification Search ..... 399/106, 399/111

See application file for complete search history.

(56) References Cited

U.S. PATENT DOCUMENTS 5,543,898 A * 8/1996 Shishido et al. ..... 399/111
5,585,902 A 12/1996 Nishiuwatoko et al.
5,729,796 A 3/1998 Miura et al.
5,815,644 A 9/1998 Nishiuwatoko et al.
5,870,655 A 2/1999 Nishiuwatoko et al.
5,893,006 A 4/1999 Kanno et al.
5,937,240 A 8/1999 Kanno et al.
5,966,566 A 10/1999 Odagawa et al.
6,070,029 A 5/2000 Nishiuwatoko et al.
6,137,971 A 10/2000 Sasaki et al.
6,137,973 A 10/2000 Nishiuwatoko et al.
6,141,508 A 10/2000 Sasaki et al.
6,901,229 B2 5/2005 Nishiuwatoko et al.
7,817,936 B2 10/2010 Kikuchi et al.

FOREIGN PATENT DOCUMENTS

JP 8-305162 11/1996
JP 2006-208898 8/2006

OTHER PUBLICATIONS

Machine translation of Mitsuru (JP8305162 (A), listed in IDS. Publication date, Nov. 22, 1996.*

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A cartridge includes: a first frame member which has an opening through which a developer accommodated therein is fed; a sealing member which seals the opening and which is pulled out to unseal the opening; a second frame member which sandwiches the sealing member with the first frame member; a welding portion which is formed on one of the first frame member and the second frame member and adapted to weld the first frame member and the second frame member at an area outside the opening; and a sandwiching portion which is formed on one of the first frame member and the second frame member and which is melted with the welding of the welding portion at an area outside the opening and inside the welding portion to sandwich the sealing member between the first frame member and the second frame member.

6 Claims, 7 Drawing Sheets

CARTRIDGE

BACKGROUND OF THE INVENTION

1. Field of the Invention

The present invention relates to a cartridge which is detachably attached to a main body of an electrophotographic image forming apparatus.

The electrophotographic image forming apparatus forms an image on a recording medium using an electrophotographic image forming process. Examples of the electrophotographic image forming apparatus include an electrophotographic copying machine, an electrophotographic printer (such as a laser beam printer and an LED printer), a facsimile machine and a word processor.

The cartridge may be, for example, a process cartridge, a development cartridge or a toner cartridge, which is detachably attached to a main body of an electrophotographic image forming apparatus and contributes to an image forming process to form an image on a recording medium.

The process cartridge is a cartridge which includes a development portion as a process portion and a photosensitive drum, which are integrated to form a cartridge, and is detachably attached to a main body of an electrophotographic image forming apparatus. Thus, a cartridge which includes one of a charging portion, cleaning portion and the development portion as a process portion, and the electrophotographic photosensitive drum, which are integrated to form a cartridge and is detachably attached to the main body is also one of process cartridges. A process cartridge integrally including an electrophotographic photosensitive drum and a development portion is referred to as a so-called integrated type cartridge. A process cartridge integrally including an electrophotographic photosensitive drum and a process portion other than the development portion is referred to as a so-called separated type cartridge.

The process cartridge can be attached to and detached from an image forming apparatus main body by a user. Therefore, maintenance of the apparatus main body can be performed easily. The process portion operates on the electrophotographic photosensitive drum.

The development cartridge also includes a development roller, which accommodates a developer (toner) used to develop an electrostatic image formed on the electrophotographic photosensitive drum, and is detachably attached to the main body. In the case of the development cartridge, the electrophotographic photosensitive drum is mounted on the apparatus main body. Alternatively, the electrophotographic photosensitive drum is arranged in the so-called separated type process cartridge (in this case, the process cartridge does not include the development portion). The development cartridge can also be attached to and detached from an image forming apparatus main body by a user. Therefore, maintenance of the apparatus main body can be performed easily.

The toner cartridge is a cartridge which accommodates a developer (toner), has an opening through which the developer is fed and which is unsealably sealed by a sealing member, and is detachably attached to the main body. The toner cartridge can also be attached to and detached from an image forming apparatus main body by a user. Therefore, maintenance of the apparatus main body can be performed easily.

2. Description of the Related Art

In the related art, an image forming apparatus using an electrophotographic image forming process employs a process cartridge system in which a photosensitive drum and a process portion operating thereon are integrated to form a cartridge, and the cartridge is detachably attachable to a main body of the image forming apparatus. In such a process cartridge, an opening formed in a developer frame member which accommodates a developer (toner) is sealed with a sealing member and the opening is unsealed by pulling the sealing member out in use to enable feeding of the developer.

A method of thermally welding a sheet-like sealing member 52, which has an adhesion layer such as a heat sealing portion 53, to a periphery of an opening of a developer frame member 51 as illustrated in FIG. 6 is known as a method for unsealably sealing an opening, as disclosed in Japanese Patent Application Laid-Open No. 2006-208898. This method is widely used with a structure in which a free end of the sealing member 52 is folded back and the heat sealing portion (welding portion) 53 is easily separated by pulling out the sealing member 52 in the direction opposite to the folded back portion (in the direction of an arrow J in FIG. 6) so as to reduce the load on the user when pulling out the sealing member.

However, in the above example of the related art, since the sealing member is provided with the adhesion layer to thermally weld the sealing member to the periphery of the opening, the structure of the sealing member is complex. Moreover, since the sealing member is folded back in view of the load to separate the welding portion when pulling out the sealing member, the length of the sealing member in the pulling direction is long (about twice as long as the portion which seals in the developer), and consequently, the pulling amount of the sealing member when unsealing the opening is large.

SUMMARY OF THE INVENTION

The present invention is attained by further developing the related art, and provides a cartridge in which sealing with a sealing member can be effected with a simple structure.

According to the present invention, there is provided a cartridge which is detachably attachable to an image forming apparatus main body, the cartridge including: a first frame member which accommodates a developer and has an opening through which the developer is fed; a sealing member which seals the opening and which is pulled out to unseal the opening; a second frame member which sandwiches the sealing member with the first frame member; a welding portion which is formed on one of the first frame member and the second frame member and adapted to weld the first frame member and the second frame member at an area outside the opening; and a sandwiching portion which is formed on one of the first frame member and the second frame member and which is melted with the welding of the welding portion at an area outside the opening and inside the welding portion to sandwich the sealing member between the first frame member and the second frame member.

Further features of the present invention will become apparent from the following description of exemplary embodiments with reference to the attached drawings.

DESCRIPTION OF THE EMBODIMENTS

In the following, an exemplary embodiment of the present invention will be described in detail as an example with reference to the drawings. Here, dimensions, materials, shapes, relative arrangements thereof and the like described in the following embodiment are to be appropriately modified in accordance with a configuration of an apparatus to which the present invention is applied and various conditions. Therefore, the embodiment is not intended to limit the scope of the present invention only to the description unless otherwise specified.

An embodiment of a cartridge and an electrophotographic image forming apparatus to which the cartridge is detachably attached will be described below with reference to FIGS. 1A to 5.

(General Configuration of Electrophotographic Image Forming Apparatus)

Figure 5:
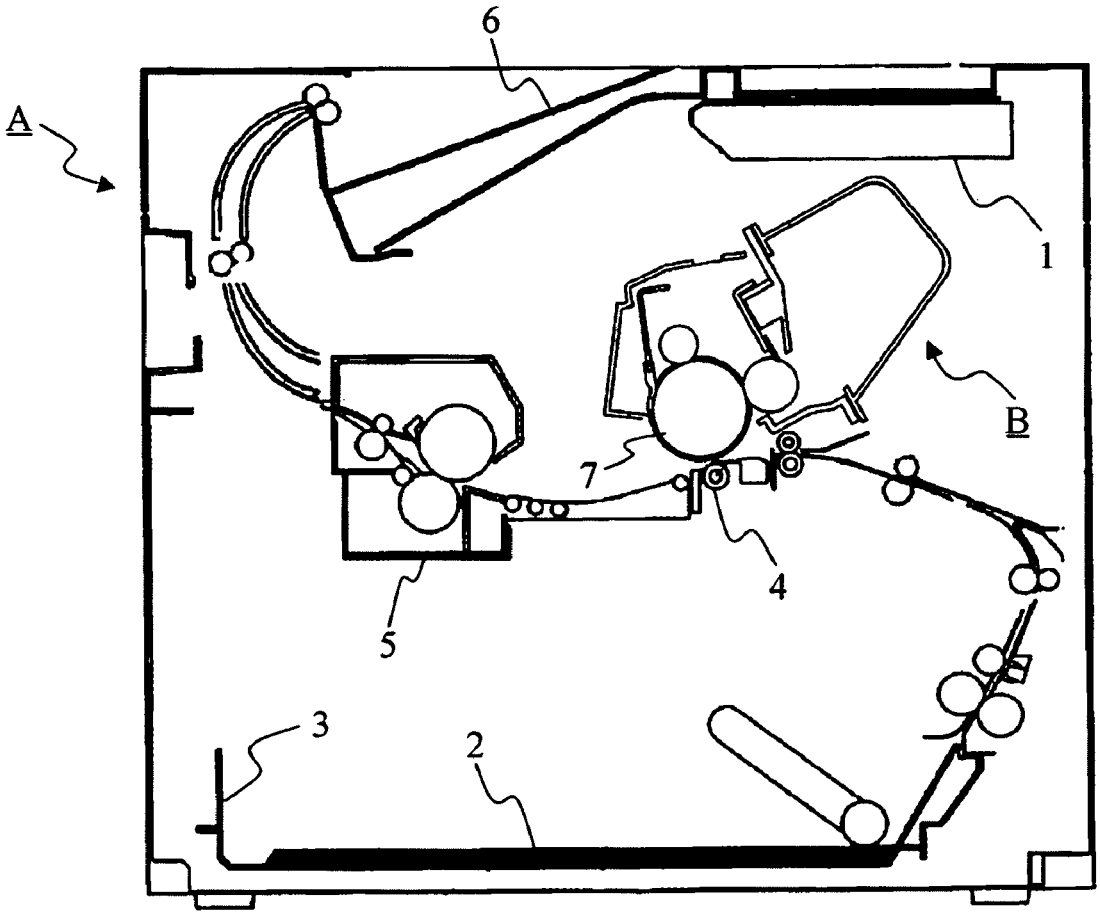
FIG. 5 is a sectional view for describing a general configuration of an electrophotographic image forming apparatus to which a process cartridge is attached.

First, the electrophotographic image forming apparatus to which the cartridge is detachably attached according to the present embodiment is described with reference to FIG. 5. FIG. 5 is a sectional view for describing a general configuration of the electrophotographic image forming apparatus (laser beam printer) to which the process cartridge is attached according to the present embodiment. As illustrated in FIG. 5, the electrophotographic image forming apparatus forms an electrostatic image on a photosensitive drum (image bearing member) 7 by irradiating the photosensitive drum 7 with information light (laser light) based on image information by an optical system 1. Then, the electrostatic image is developed with a developer (hereinafter referred to as "toner") to form a toner image. A recording medium 2 is conveyed from a sheet cassette 3 in synchronization with the formation of the toner image, the toner image formed on the photosensitive drum 7 is transferred to the recording medium 2 by a transfer roller 4, the transferred toner image is fixed onto the recording medium 2 by a fixing portion 5, and then the recording medium 2 is discharged to a discharge portion 6. The recording medium is a medium on which an image is formed by the electrophotographic image forming apparatus, and examples thereof include paper and an OHP sheet.

(General Configuration of Process Cartridge)

Figure 4A:
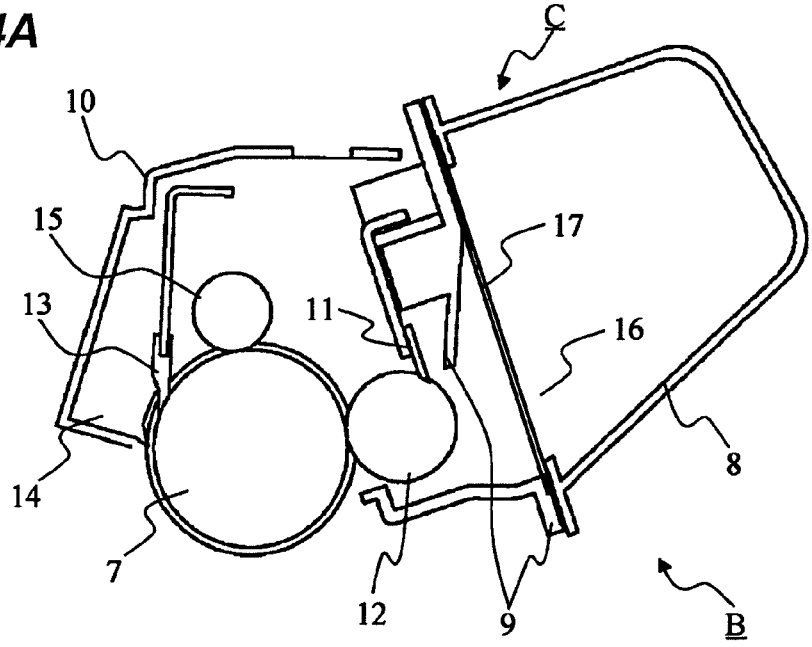
FIG. 4A is a side sectional view of a process cartridge before the sealing member is pulled out.
Figure 4B:
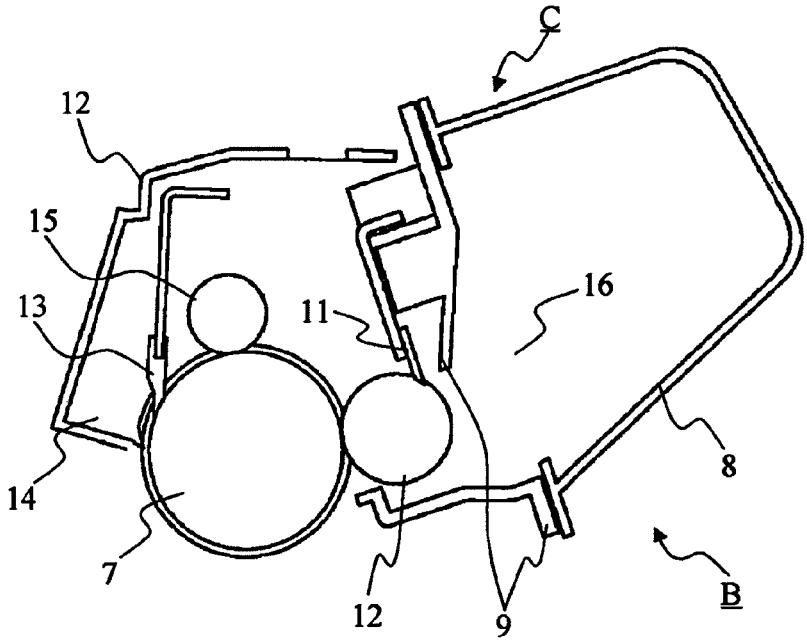
FIG. 4B is a side sectional view of the process cartridge after the sealing member is pulled out.

Next, a process cartridge B is described with reference to FIGS. 4A and 4B. FIG. 4A is a sectional view of a process cartridge in a state in which a sealing member seals an opening. FIG. 4B is a sectional view of the process cartridge in a state in which the sealing member is pulled out to unseal the opening.

Figure 6:
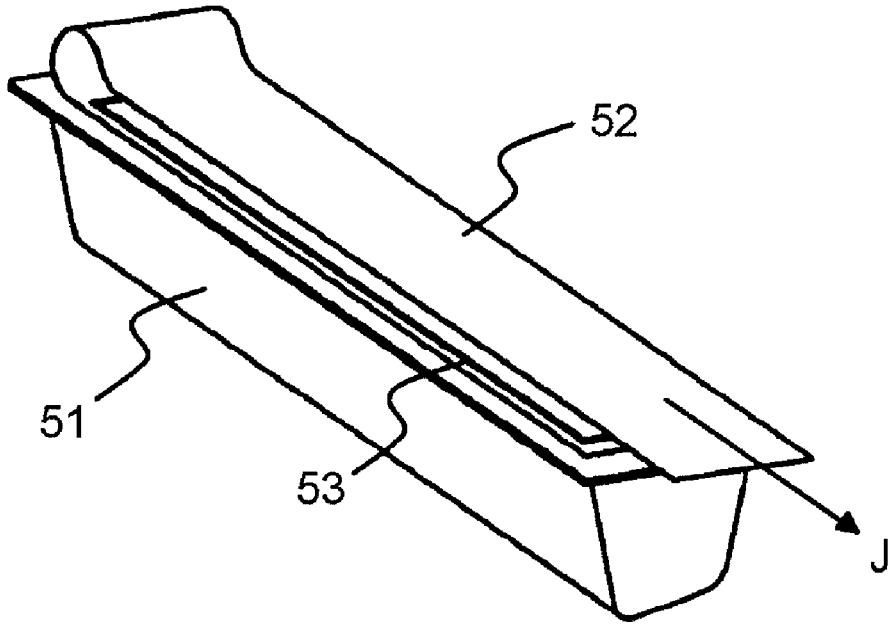
FIG. 6 PRIOR ART
FIG. 6 is a perspective view for describing an example of the related art.

The process cartridge B has a structure in which a development unit C and a cleaning frame member 10 are connected to each other in a manner that the development unit C and the cleaning frame member 10 can turn with respect to each other and which is detachably attachable to a main body A of the electrophotographic image forming apparatus. The development unit C has a structure integrally connecting a toner frame member (a first frame member which is a developer frame member) 8 which accommodates a developer (toner), and a development frame member (a second frame member which is a sandwiching member) 9 which supports a development portion such as a development roller (developer bearing member) 12. The toner frame member 8 and the development frame member 9 are made of molded polystyrene, for example. The cleaning frame member 10 supports the photosensitive drum (image bearing member) 7, a charging roller (charging portion) 15, and cleaning blade (cleaning portion) 13. In the process cartridge B, an opening 16 of the toner frame member 8 is sealed with a sealing member 17. The sealing member 17 is pulled out to unseal the opening 16 when using the process cartridge B. The direction in which the sealing member is pulled is a direction along the longitudinal direction of the first frame member 8 and the second frame member 9 (the rotational axis direction of the developer frame member) as also shown by an arrow J in FIG. 6. Examples of the sealing member 17 include a sheet-like member (such as a PET sheet and a PPS sheet) and a plate-like member.

When the opening 16 is unsealed by pulling the sealing portion 17 out, toner (not illustrated) accommodated in the toner frame member 8 is fed through the opening 16 to the development frame member 9 to form a toner layer to which a frictional charge is applied by the development blade 11 on the surface of the development roller 12. The toner is transferred to the photosensitive drum 7 according to the electrostatic image to form a toner image. After the toner image is transferred to the recording medium 2 by the transfer roller 4, the toner remaining on the photosensitive drum 7 is cleared away by the cleaning blade 13 into a waste toner reservoir 14. Subsequently, the surface of the photosensitive drum 7 is uniformly charged by the charging roller 15 to be ready for a latent image to be formed by the optical system 1.

(General Configuration of Development Unit)

Figure 3A:
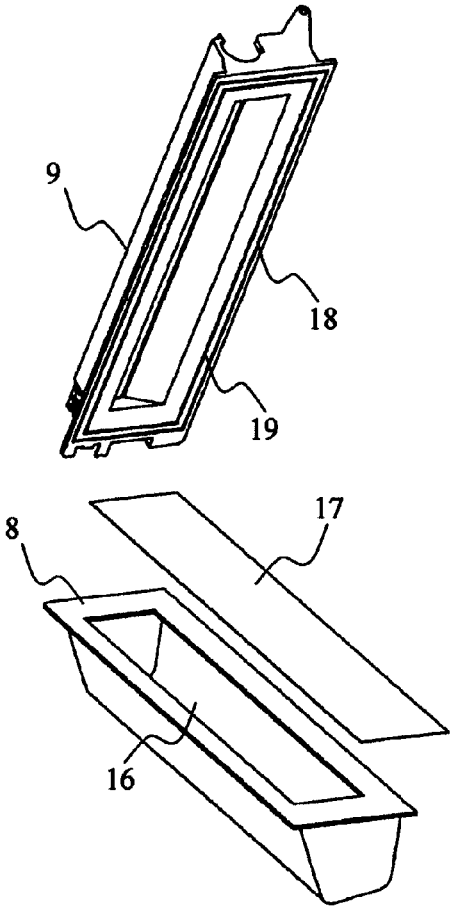
FIG. 3A is a perspective view for describing a structure of the toner frame member and the development frame member and the positional relation of the sealing member according to the present embodiment.
Figure 3B:
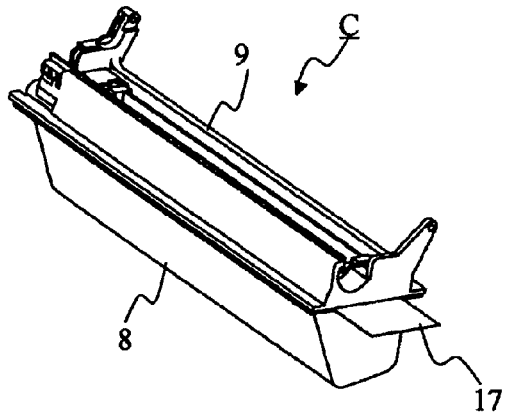
FIG. 3B is a perspective view for describing the state after welding of the toner frame member and the development frame member according to the present embodiment.

Next, a method of bonding the toner frame member (first frame member) 8 and the development frame member (second frame member) 9 and a method of sealing the opening 16 by the sealing member 17 are described with reference to FIGS. 3A and 3B. FIG. 3A is a perspective view for describing the structure of the toner frame member 8 and the development frame member 9 and the positional relation of the sealing member 17. FIG. 3B is a perspective view for describing the state after welding of the toner frame member 8 and the development frame member 9. The toner frame member 8 and the development frame member 9 are bonded to each other by welding (ultrasonic welding, for example) in a state where the opening 16 of the toner frame member 8 is covered with the sealing member 17 and one end portion of the sealing member 17 is outside the toner frame member 8. In this case, a welding rib (welding portion) 18 for bonding is used. A welding rib (welding portion) 18, which is a bonding portion, is formed on one of the toner frame member 8 and the development frame member 9, and is used to weld the toner frame member 8 and the development frame member 9 at an area outside the opening 16. Although the structure in which the welding rib 18 is formed on the development frame member 9 is described as an example here, the present invention is not limited thereto. By bonding the toner frame member 8 and the development frame member 9, the sealing member 17 is sandwiched between a sandwiching rib (sandwiching portion) 19 and a portion (toner frame member 8) opposed to the sandwiching rib 19 to seal the opening 16. The sandwiching rib (sandwiching portion) 19 is formed on one of the toner frame member 8 and the development frame member 9. Similarly to the welding rib 18, although the structure in which the sandwiching rib 19 is formed on the development frame member 9 is described as an example here, the present invention is not limited thereto. The sandwiching rib 19 is formed in an area inside the welding rib 18 and outside the opening 16.

Figure 1A:
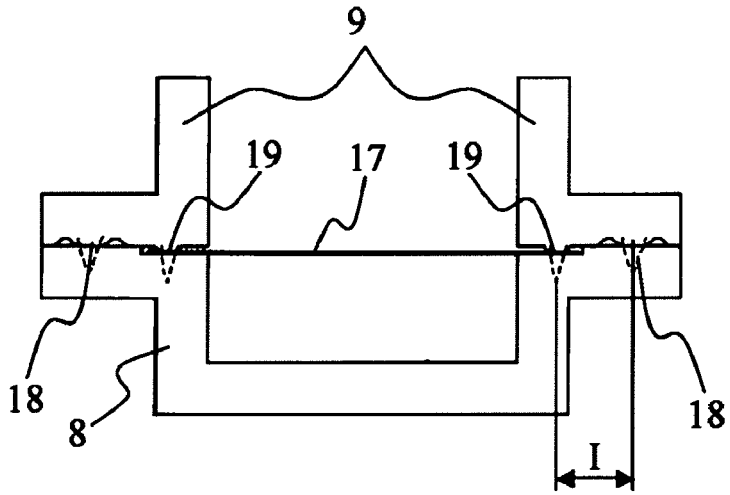
FIG. 1A is a sectional view for describing a state after welding of a toner frame member and a development frame member and a state of sandwiching a sealing member according to the present embodiment.
Figure 1B:
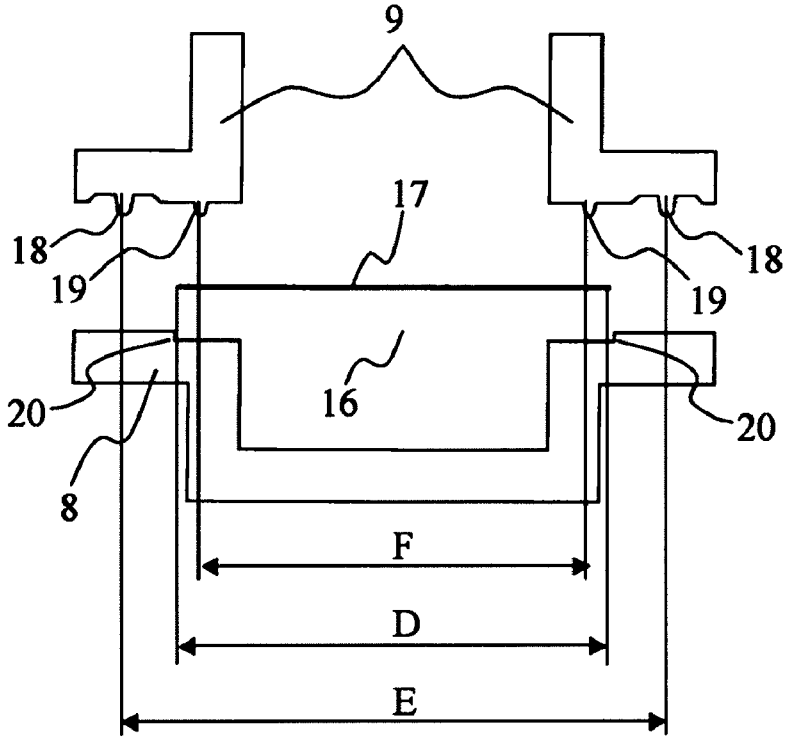
FIG. 1B is a sectional view for describing a state before welding of the toner frame member and the development frame member and a positional relation of the sealing member according to the present embodiment.

Next, a method of sealing the opening 16 is described in more detail with reference to FIGS. 1A and 1B. FIG. 1A is a sectional view for describing a state after welding of the toner frame member 8 and the development frame member 9 and a state of sandwiching the sealing member 17. FIG. 1B is a sectional view for describing a state before welding of the toner frame member 8 and the development frame member 9 and the positional relation of the sealing member 17.

First, the state before welding is described with reference to FIG. 1B. The width D of the sealing member 17 in the short side direction is smaller than the distance E between two welding ribs 18 and larger than the distance F between two sandwiching ribs 19. The sealing member 17 is set to cover the opening 16. The sealing member 17 is set inside the two welding ribs 18 when the toner frame member 8 and the development frame member 9 are joined. The sealing member 17 is also set to be sandwiched between the two sandwiching ribs 19 and portions opposed to the sandwiching ribs 19. In order to facilitate positioning of the sealing member 17, a stepped portion (positioning portion) 20 for positioning the sealing member 17 is formed at the portion opposed to each sandwiching rib 19. The positioning can be easily performed by causing an end portion of the sealing member to abut the stepped portion (positioning portion) 20. Although the stepped portion 20, which is the positioning portion, is formed on the toner frame member 8 at the portion opposed to the sandwiching rib 19 here, the present invention is not limited thereto. When the sandwiching rib 19 is formed on the toner frame member 8, the stepped portion is formed on the development frame member 9 at a portion opposed to the sandwiching rib 19. In the state where the sealing member 17 is set on the stepped portion 20, the toner frame member 8 and the development frame member 9 are joined to sandwich the sealing member 17 between the sandwiching rib 19 and the toner frame member 8 at the portion opposed to the sandwiching rib 19, and the toner frame member 8 and the development frame member 9 are welded.

Figure 7:
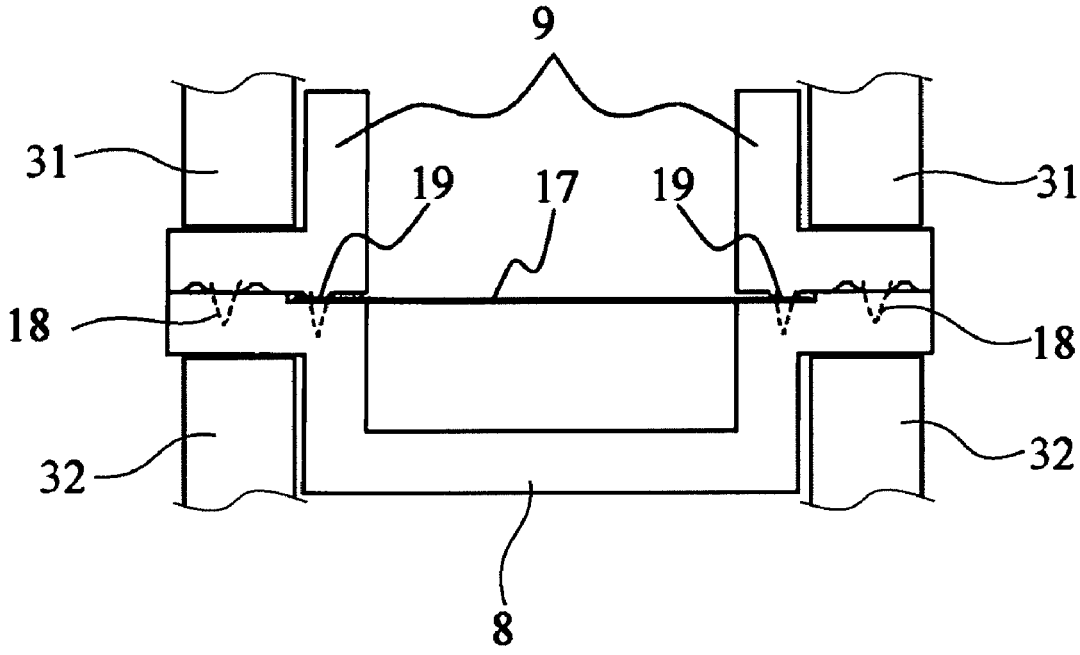
FIG. 7 is a diagram illustrating a state in which the toner frame member and the development frame member are welded.

Here, the welding of the toner frame member 8 and the development frame member 9 in the state where the sealing member 17 is sandwiched therebetween is described with reference FIG. 7. A vibration applying portion 31 which applies ultrasonic vibration is pressed against one side on which the welding rib 18 is formed (the side of the development frame member 9). A backup portion 32 which receives the frame member pressed by the vibration applying portion 31 is formed on the other side on which the welding rib 18 is formed (the side of the toner frame member 8). That is, the toner frame member 8 and the development frame member 9 are subjected to ultrasonic welding by applying ultrasonic vibration by the vibration applying portion 31 in a state where the toner frame member 8 and the development frame member 9 are sandwiched between the vibration applying portion 31 and the backup portion 32. As an example of conditions of the ultrasonic welding, the ultrasonic frequency in the range of 20 to 40 KHz, the pressure applied during welding in the range of 0.2 to 0.4 KPa, and the welding time in the range of 0.3 to 0.7 seconds are used. These numerical values may be appropriately selected to be optimal depending on the material or the structure of the frame members. In FIG. 7, the vibration applying portion 31 is caused to abut the development frame member 9 and the backup portion 32 is caused to abut the toner frame member 8, the positions of the vibration applying portion 31 and the backup portion 32 may be replaced by each other.

Figure 2A:
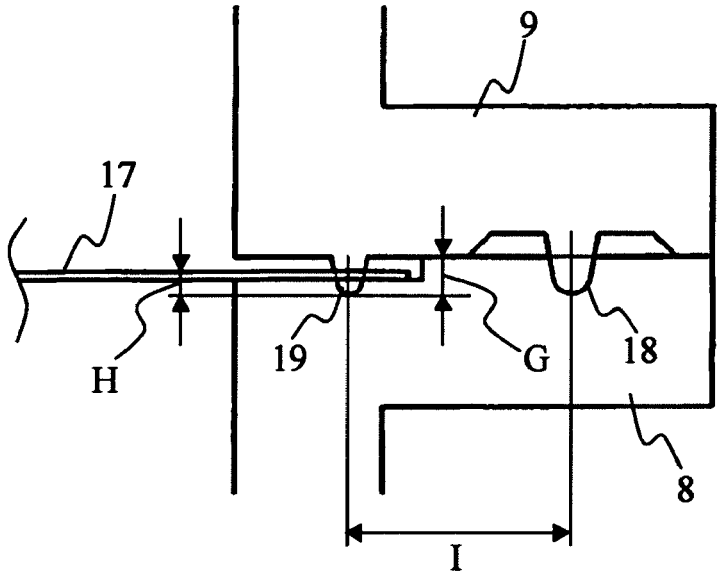
FIGS. 2A and 2B are sectional views for describing a penetration amount of a sandwiching rib into the sealing member and a positional relation between a welding rib and the sandwiching rib.
Figure 2B:
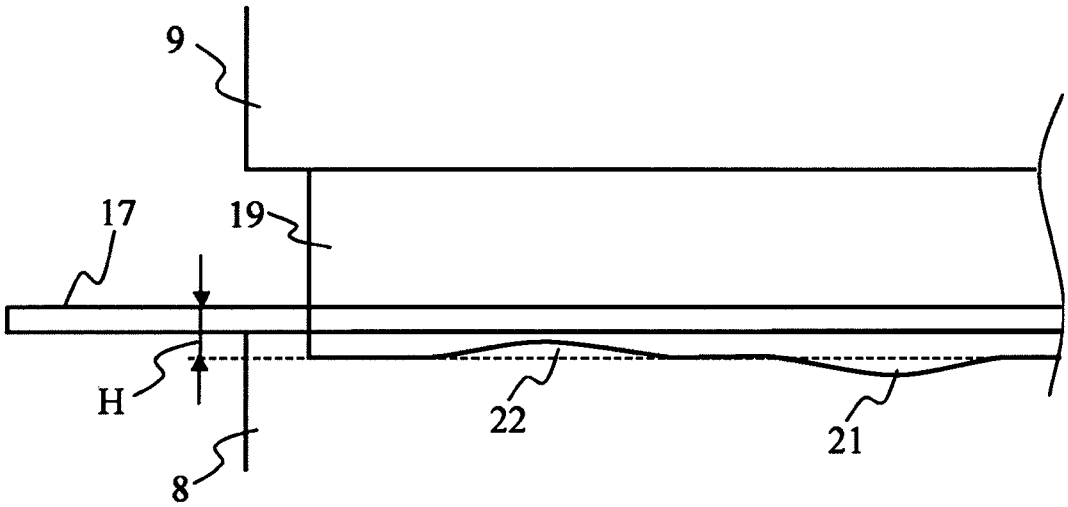

Here, the state of sandwiching the sealing member 17 before welding is described with reference to FIGS. 2A and 2B. FIGS. 2A and 2B are sectional views for describing the penetration amount H of the sandwiching rib 19 into the sealing member 17 and the positional relation between the welding rib 18 and the sandwiching rib 19 in a state where the relative positions of the toner frame member 8 and the development frame member 9 are the positions when the welding is completed. In this case, if it is assumed that the height G of the sandwiching rib 19 is 0.5 mm and that the sandwiching rib 19 is not deformed at the time when the welding of the toner frame member 8 and the development frame member 9 is completed, the penetration amount H of the sandwiching rib 19 into the sealing member 17 will be 0.3 mm. In fact, however, the penetration amount H is uneven over the whole area of the sandwiching rib 19 as viewed laterally as illustrated in FIG. 2B due to the tolerance of the height G of the sandwiching rib 19 and the like. That is, a portion 21 and a portion 22 at which the penetration amount H of the sandwiching rib 19 into the sealing member 17 is larger and smaller, respectively, than the set amount (0.3 mm in this case) are present, and thus the sandwiched state of the sealing member 17 by the sandwiching rib 19 varies.

Next, the state of sandwiching the sealing member 17 after welding is described with reference to FIG. 1A. When the welding is performed, the welding rib 18 formed on the development frame member 9 is melted by heat and pressure of the welding and integrated with the toner frame member 8. As a result, the toner frame member 8 and the development frame member 9 are bonded. The sandwiching rib 19 is arranged in the vicinity of the welding rib 18. Accordingly, by the welding of the toner frame member 8 and the development frame member 9, the portion of the sandwiching rib 19 penetrating into the sealing member 17 is melted at the same time. In this case, by setting the distance I between the welding rib 18 and the sandwiching rib 19 to 3 mm, the sandwiching rib 19 is melted at the same time by the welding. As a result of melting the sandwiching rib 19, a uniform sandwiching state without any gap over the whole area including portions at which the melting amount of the sealing member 17 is large and small can be obtained. Thus, the opening 16 can be sealed. In this manner, by melting the sandwiching rib 19 using the welding process of the toner frame member 8 and the development frame member 9, the assembly process can be shortened. Moreover, the welding rib 18 formed on the development frame member 9 and the toner frame member 8 are firmly bonded after the welding, thereby the rigidity is ensured. Accordingly, the relative positional relation between the sandwiching rib 19 arranged in the vicinity of (in this case, at 3 mm from) the welding rib 18 and the toner frame member 8 is also maintained stably, the sandwiching state of the sealing member 17 is stabilized, and the sealing state of the opening 16 is also stabilized.

The material of the sealing member 17 is a material (such as polyester resins (PET, for example) and PPS) having low compatibility with the material (such as polystyrene) of the sandwiching rib 19 formed on the development frame member 9 and the toner frame member 8 opposed to the sandwiching rib 19. Accordingly, the sealing member 17 is not bonded with the melted sandwiching rib 19 and toner frame member 8, and thus the sealing member 17 can be pulled out after the melting.

As described above, since the sealing portion need not be heat-welded according to the present embodiment, the adhesion layer of the sealing member is not required, thereby the structure of the sealing member can be simplified (into a single-layer member, for example).

In addition, since the sealing member is not welded to the periphery of the opening, the pulling amount of the sealing member is not necessary to be considered when unsealing the periphery of the opening. Accordingly, the folded back portion of the sealing member is no longer necessary, the length of the sealing member in the pulling direction can be shortened and the pulling amount of the sealing member can be made smaller.

Further, since the sandwiching rib can be melted by using the welding process of the toner frame member and the development frame member, the assembly process can be shortened.

Still further, since the sandwiching rib is positioned in the vicinity of the bonding portion (welding portion) of the toner frame member and the development frame member, the rigidity around the sandwiching rib can be ensured, and the relative positional relation between the sandwiching rib and the sealing member can be maintained stably.

Although the process cartridge in which the electrophotographic photosensitive drum and the process portion operating thereon are integrated is described as an example of the cartridge which is detachably attachable to the image forming apparatus main body in the embodiment described above, the present invention is not limited thereto. The cartridge may be a process cartridge in which a development portion as the process portion is provided integrally with the electrophotographic photosensitive drum and which is detachably attached to the main body of the electrophotographic image forming apparatus. Thus, a cartridge which includes one of a charging portion, a cleaning portion and a development portion as a process portion, and an electrophotographic photosensitive drum, which are integrated to form a cartridge and is detachably attached to the main body is also one of process cartridges.

Further, the cartridge detachably attached to the main body is not limited to the process cartridge and may be a development cartridge or a toner cartridge. The development cartridge includes a development roller (developer bearing member), which accommodates a developer (toner) used to develop an electrostatic image formed on the electrophotographic photosensitive drum, and is detachably attached to the main body. In the case of the development cartridge, the electrophotographic photosensitive drum is mounted on the apparatus main body. Alternatively, the electrophotographic photosensitive drum is arranged in the so-called separated type process cartridge (in this case, the process cartridge does not include the development portion). The toner cartridge is cartridge which accommodates a developer (toner), has an opening through which the developer is fed and which is unsealably sealed by a sealing member, and is detachably attached to the main body. The same effects as the embodiment described above can also be obtained even when the present application is applied to any of these cartridges.

Although one process cartridge is used in this embodiment described above, the number of the cartridges to be used is not limited thereto, and may be appropriately set as necessary.

Further, although the printer is described as an example of the electrophotographic image forming apparatus in the embodiment described above, the present invention is not limited thereto. For example, the electrophotographic image forming apparatus may be other image forming apparatuses such as a facsimile machine or a multifunction machine having combined functions thereof. The same effects can be obtained by applying the present invention to any cartridge detachably attached to these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-206534, filed Sep. 8, 2009, No. 2010-147461, filed Jun. 29, 2010 which are hereby incorporated by reference herein in their entirety.

What is claimed is:

1. A cartridge which is detachably attachable to an image forming apparatus main body, the cartridge comprising:

a first frame member which accommodates a developer and has an opening through which the developer is fed;

a sealing member which seals the opening and which is pulled out to unseal the opening;

a second frame member which sandwiches the sealing member with the first frame member;

a welding portion which is formed on one of the first frame member and the second frame member and adapted to weld the first frame member and the second frame member at an area outside the opening; and a sandwiching portion that (i) is formed on one of the first frame member and the second frame member, (ii) is melted at an area outside the opening and inside the welding portion, and (iii) contacts with the sealing member so as to sandwich the sealing member between the first frame member and the second frame member.

2. The cartridge according to claim 1, further comprising:

a positioning portion which is formed on one of the first frame member and the second frame member and to which an end of the sealing member is caused to abut to position the sealing member, wherein the positioning portion is located outside the sandwiching portion and inside the welding portion.

3. The cartridge according to claim 1, wherein the second frame member supports a developer bearing member which bears the developer and develops an electrostatic image formed on an image bearing member.

4. The cartridge according to claim 1, further comprising:

an image bearing member on which an electrostatic image is formed, wherein the second frame member supports a developer bearing member which bears the developer and develops the electrostatic image formed on the image bearing member.

5. The cartridge according to claim 1, wherein the sandwiching portion is melted when the welding portion welds the first frame member and the second frame member.

6. The cartridge according to claim 1, wherein the sealing member does not bond with the sandwiching portion when the sandwiching portion is melted.

* * * * *